US009593583B2

(12) United States Patent
Walker et al.

(10) Patent No.: US 9,593,583 B2
(45) Date of Patent: Mar. 14, 2017

(54) NICKEL-BASE SUPERALLOY

(75) Inventors: Paul Mathew Walker, Dunholme (GB); Mick Whitehurst, Hayle (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 671 days.

(21) Appl. No.: 13/825,140

(22) PCT Filed: Aug. 19, 2011

(86) PCT No.: PCT/EP2011/064310

§ 371 (c)(1),
(2), (4) Date: Mar. 20, 2013

(87) PCT Pub. No.: WO2012/038166

PCT Pub. Date: Mar. 29, 2012

(65) Prior Publication Data

US 2013/0177442 A1 Jul. 11, 2013

(30) Foreign Application Priority Data

Sep. 20, 2010 (EP) ..... 10177620

(51) Int. Cl.
*C22C 19/05* (2006.01)
*F01D 5/14* (2006.01)

(52) U.S. Cl.
CPC ..... *F01D 5/147* (2013.01); *C22C 19/055* (2013.01); *C22C 19/056* (2013.01)

(58) Field of Classification Search
CPC ..... F01D 5/28; F05D 2300/13
USPC ..... 415/200; 416/241 R
See application file for complete search history.

(56) References Cited

U.S. PATENT DOCUMENTS

| | | | | | |
|---|---|---|---|---|---|
| 362,064 | A * | 5/1887 | Daniels | H02G 13/00 | 16/DIG. 40 |
| 3,333,957 | A * | 8/1967 | Thielemann | C22C 19/07 | 420/439 |
| 3,459,545 | A * | 8/1969 | Galka | C22C 19/056 | 420/448 |
| 3,526,499 | A * | 9/1970 | Collins | C22C 19/00 | 164/122 |
| 3,677,747 | A * | 7/1972 | Lund | C22C 19/056 | 420/448 |
| 4,039,330 | A | 8/1977 | Shaw | | |
| 4,152,488 | A * | 5/1979 | Schilke | C22C 19/055 | 148/281 |

(Continued)

FOREIGN PATENT DOCUMENTS

| | | | |
|---|---|---|---|
| CN | 1432659 | A | 7/2003 |
| CN | 101294250 | A | 10/2008 |

(Continued)

*Primary Examiner* — Thomas Denion
*Assistant Examiner* — Shafiq Mian

(57) ABSTRACT

A nickel-base superalloy for turbine vanes or turbine blades is provided. The nickel-base superalloy has in wt %: C: equal to or greater 0.1; Si: </=0.2; Mn: </=0.2; P: </=0.005; S: </=0.0015; Al: 4.0 to 5.5; B: </=0.03; Co: 5.0 to 9.0; Cr: 18.0 to 22.0; Cu: </=0.1; Fe: </=0.5; Hf: 0.9 to 1.3; Mg: </=0.002; Mo: </=0.5; N: </=0.0015; Nb: </=0.01; O: </=0.0015; Ta: 4.8 to 5.2; Ti: 0.8 to 2.0; W: 1.8 to 2.5; Zr: </=0.01; Ni: balance; and inevitable impurities.

6 Claims, 1 Drawing Sheet

(56) References Cited

U.S. PATENT DOCUMENTS

| | | | | |
|---|---|---|---|---|
| 4,437,913 | A * | 3/1984 | Fukui | C22C 19/07 148/408 |
| 4,526,749 | A * | 7/1985 | Huber, Jr. | C22C 27/02 148/422 |
| 5,141,704 | A * | 8/1992 | Kondo | C22C 19/056 148/428 |
| 7,632,075 | B2 * | 12/2009 | Liang | F01D 5/141 416/223 A |
| 8,105,043 | B2 * | 1/2012 | Tsifourdaris | F01D 5/14 416/223 R |
| 2003/0041930 | A1 | 3/2003 | Biondo et al. | |
| 2004/0005409 | A1 * | 1/2004 | Das | C23C 8/04 427/250 |
| 2005/0194068 | A1 | 9/2005 | Blackler et al. | |
| 2008/0279714 | A1 * | 11/2008 | Hashimura | C21D 8/06 420/118 |

FOREIGN PATENT DOCUMENTS

| | | | |
|---|---|---|---|
| EP | 0325760 | A1 | 8/1989 |
| EP | 1914327 | A1 | 4/2008 |
| JP | 10317080 | A | 12/1998 |
| JP | H10317080 | A | 12/1998 |
| RU | 2016118 | C1 | 7/1994 |
| RU | 2454476 | C2 | 6/2012 |

* cited by examiner

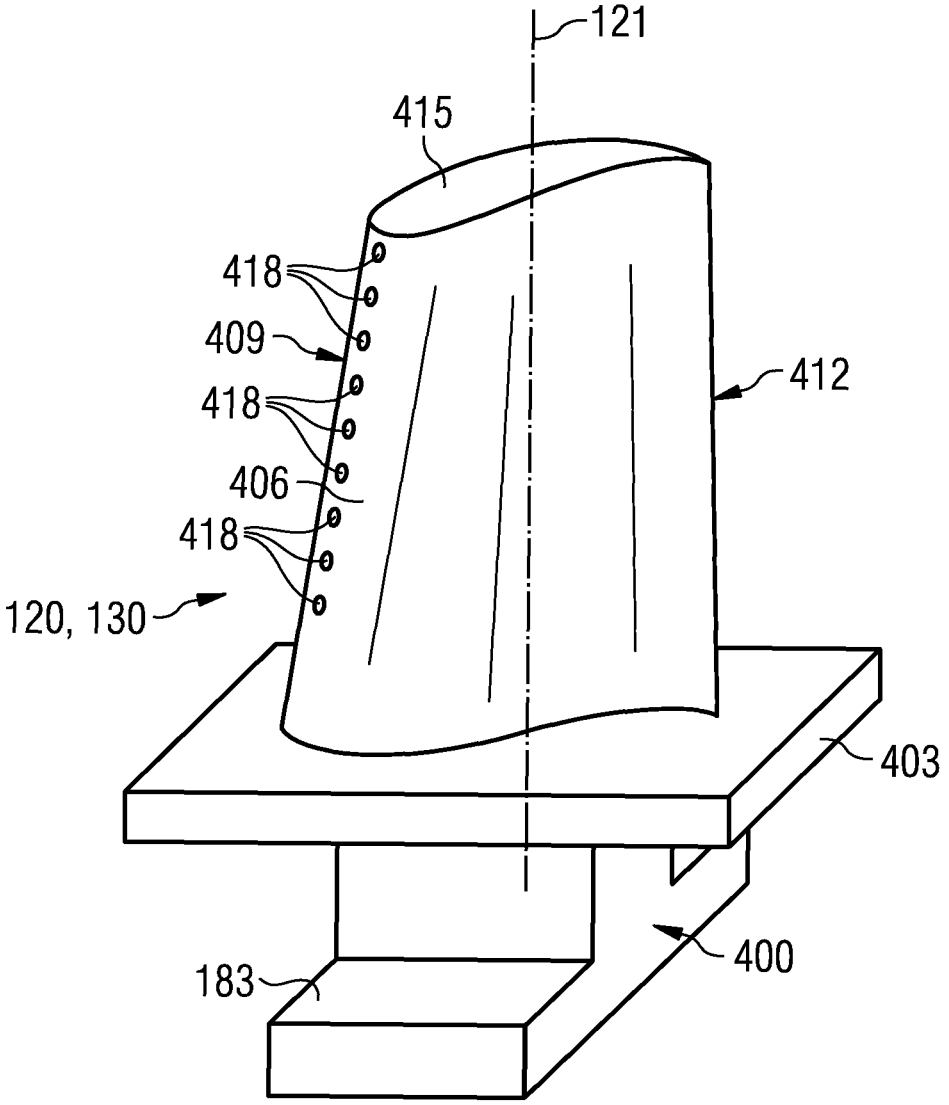
121
415
418
409
418
406
418
120, 130
412
403
400
183

NICKEL-BASE SUPERALLOY

CROSS REFERENCE TO RELATED APPLICATIONS

This application is the US National Stage of International Application No. PCT/EP2011/064310 filed Aug. 19, 2011 and claims the benefit thereof. The International Application claims the benefits of European application No. 10177620.1 filed Sep. 20, 2010, both of the applications are incorporated by reference herein in their entirety.

FIELD OF THE INVENTION

The present invention relates to a nickel-base superalloy which may be used in turbine components, in particular in gas turbine components with a directionally solidified (DS) or a single crystal (SX) structure. Nickel-base superalloys are often used for components which are to operate in a hot and corrosive environment such as blades and vanes of gas turbines which are exposed to the hot and corrosive combustion gases driving the turbine. In such environments, a high strength and a strong resistance to chemical attacks at high temperatures is needed.

BACKGROUND OF THE INVENTION

Even though nickel-base superalloys with high strength and strong resistance to chemical attacks at high temperatures are known from the state of the art, for example from EP 1 914 327 A1 and documents cited therein, components made of these materials still need to be protected by corrosion resistant coatings like the so called MCrAlY-coatings, where M stands for iron (Fe) cobalt (Co) or nickel (Ni), Cr stands for chromium, Al stands for aluminium and Y stands for an active element, in particular for yttrium (Y). However, silicon (Si) and/or at least one of the rare earth elements or hafnium (Hf) can be used as the active element in addition to yttrium or as an alternative to yttrium. Furthermore, often thermal barrier coatings are applied onto the corrosion resistant coating in order to reduce the temperature experienced by this coating and the underlying nickel-base superalloy.

There is a trend to increase the temperature of the combustion gases, i.e. the inlet temperature at the turbine entrance, which is related to the aim of increasing the turbine efficiency that in turn depends on the inlet temperature at the turbine entrance. Hence, all parts of a turbine components, i.e. the superalloy of the component and the corrosion resistive coating as well as the thermal barrier coating, need to be improved for allowing the components to operate at higher temperatures.

Moreover, there is a desire not to coat certain areas of turbine blades or vanes, in particular the fixing sections of the blades by which the blades or vanes are fixed to a rotor or a casing. This, however, means that the corrosion resistance of the superalloy itself needs to be sufficiently high.

SUMMARY OF THE INVENTION

The present invention deals with improvements of the nickel-base superalloy.

It is an objective of the present invention to provide a nickel-base superalloy that provides high corrosion resistance combined with a high creep strength. It is a further objective of the present invention to provide a turbine component, in particular a turbine blade or vane, with an high corrosion resistance and a high creep strength.

These objectives are solved by a nickel-base superalloy and by a turbine component as claimed in the independent claims. The depending claims contain further developments of the present invention.

An inventive nickel-base superalloy comprises (in wt %):

carbon (C): ≤0.1
silicon (Si): ≤0.2
manganese (Mn): ≤0.2
phosphorus (P): ≤0.005
sulphur (S): ≤0.0015
aluminium (Al): 4.0 to 5.5
boron (B): ≤0.03
cobalt (Co): 5.0 to 9.0
chromium (Cr): 18.0 to 22.0
copper (Cu): ≤0.1
iron (Fe): ≤0.5
hafnium (Hf): 0.9 to 1.3
manganese (Mg): ≤0.002
molybdenum (Mo): ≤0.5
nitrogen (N): ≤0.0015
niobium (Nb): ≤0.01
oxygen (O): ≤0.0015
tantalum (Ta): 4.8 to 5.2
titanium (Ti): 0.8 to 2.0
tungsten (W): 1.8 to 2.5
zirconium (Zr): ≤0.01
nickel (Ni): balance
and inevitable impurities.

In particular, the inventive nickel-base superalloy may comprise (in wt %):

C: 0.03 to 0.07
Si: ≤0.2
Mn: ≤0.2
P: ≤0.005
S: ≤0.0015
Al: 4.2 to 4.4
B: ≤0.01
Co: 7.8 to 8.5
Cr: 18.2 to 19.2
Cu: ≤0.1
Fe: ≤0.5
Hf: 1.0 to 1.2
Mg: ≤0.002
Mo: ≤0.5
N: ≤0.0015
Nb: ≤0.01
O: ≤0.0015
Ta: 4.9 to 5.1
Ti: 1.1 to 1.3
W: 2.0 to 2.4
Zr: 0.03 to 0.07
Ni: balance
and inevitable impurities.

Although the inventive nickel-base superalloy shows high corrosion resistance and creep strength in all compositions given above the compositions according to the first and second variant show particularly good results in corrosion resistance and creep strength.

An inventive turbine component, which may in particular be a gas turbine blade or vane, is made of an inventive nickel-base superalloy. If the turbine component is a gas turbine component it is advantageous if it has a directionally solidified structure (DS structure) or a single crystal structure (SX structure).

When forming a gas turbine blade or vane with the inventive nickel-base superalloy the corrosion resistance of the blade or vane is high enough so that there is no need to provide a corrosion resistant coating onto a fixing section (or fixing sections) of the blade or vane. Hence, in a further development the turbine component which is a blade or vane this component comprised a fixing section without coating.

BRIEF DESCRIPTION OF THE DRAWINGS

Further features, properties and advantages of the present invention will become clear from the following description of embodiments of the present invention in conjunction with the accompanying drawing.

FIGURE schematically shows a gas turbine blade or vane.

DETAILED DESCRIPTION OF THE INVENTION

FIGURE shows a perspective view of a rotor blade 120 or a guide vane 130 of a gas turbine, which may be a gas turbine of an aircraft or of a power plant for generating electricity. However, a similar blades or vanes also used in steam turbines or compressors.

The blade or vane 120, 130 extends along a longitudinal axis 121 and has, in succession along its longitudinal axis 121, a fixing region (also called blade root), an adjoining platform 103 and an airfoil 406 extending from the platform 403 to a tip 415. As a guide vane 130, the vane may have a further platform at its tip end and a further fixing section extending from the further platform. The fixing section has, in the shown embodiment a hammer head form. However, other configurations like a fir-tree or dove-tail are also possible.

The blade or vane 120, 130 comprises a leading edge 409 which shows towards the incoming combustion gas and a trailing edge 412 which shows away from the incoming combustion gas. The airfoil extends from the leading to the trailing edge and forms an aerodynamic surface which allows for transferring momentum from the streaming combustion gas to the blade 120. In a vane 130, the airfoil allows to guide the streaming combustion gases so as to optimize the momentum transfer to the turbine blades and, hence, so as to optimize the momentum transfer from the streaming combustion gas to the turbine.

The whole blade or vane 120, 130 is made of a nickel-base superalloy and formed by an investment casting process. In the present embodiment, the airfoil section 406 and a least parts of the platform 403 are coated with a corrosion resistive coating, for example a MCrAlY-coating, and a thermal barrier coating overlying the corrosion resistive coating. The fixing section 400 is uncoated.

According to the invention, a nickel-base superalloy is used as the base material of the turbine blade or vane 120, 130. The nickel-base superalloy comprises (in wt %):

C: ≤0.1, preferably 0.03 to 0.07
Si: ≤0.2
Mn: ≤0.2
P: ≤0.005
S: ≤0.0015
Al: 4.0 to 5.5, preferably 4.2 to 4.4
B: ≤0.03, preferably ≤0.01
Co: 5.0 to 9.0, preferably 7.8 to 8.5
Cr: 18.0 to 22.0, preferably 18.2 to 19.2
Cu: ≤0.1
Fe: ≤0.5
Hf: 0.9 to 1.3, preferably 1.0 to 1.2
Mg: ≤0.002
Mo: ≤0.5
N: ≤0.0015
Nb: ≤0.01
O: ≤0.0015
Ta: 4.8 to 5.2, preferably 4.9 to 5.1
Ti: 0.8 to 2.0, preferably 1.1 to 1.3
W: 1.8 to 2.5, preferably 2.0 to 2.4
Zr: ≤0.01, preferably 0.03 to 0.07
Ni: balance
and inevitable impurities.

The mentioned nickel-base superalloy offers a high creep strength and, at the same time, a high corrosion resistance so that there is no need for coating the fixing section 400 of the blade or vane 120, 130.

Preferably, the investment casting is performed with a directionally solidification of the component so as to form a directionally solidified structure (DX-structure) or a single crystal structure (SX-structure). In a directionally solidification, dendritic crystals are oriented along a directional heat flow and form either a columnar crystalline grain structure (i.e. grains which run over the entire length of the work piece and are referred to here, in accordance with the language customarily used, as directionally solidified (DX)), or a single crystal structure, i.e. the entire work piece consists of a single crystal. In this process, a transmission to globular (polycrystalline) solidification needs to be avoided, since non-directional growth inevitably forms transverse and longitudinal grain boundaries, which negate the favourable properties of the directionally solidified (DX) or single crystal (SX) component.

According to a concrete example, a nickel-base superalloy having the following composition forms the base material of the turbine blade or vane 120:

C: 0.04
Si: 0.001
Al: 4.2
B: 0.001
Co: 8.0
Cr: 18.2
Fe: 0.07
Hf: 0.9
Nb: 0.008
Ta: 4.9
Ti: 1.1
W: 2.0
Ni: balance
and inevitable impurities.

Compared to for example a nickel-base superalloy of the IN 6203 type, the superalloy above can provide the same stress rupture life than IN-6203 but at a temperature about 20° Celsius higher than IN-6203. Moreover, the alloy mentioned above has a low electron vacancy number Nv of 2.59. The electron vacancy number is a measure for the tendency to form brittle phases at high temperatures. The lower the electron vacancy number Nv is the less is the tendency to form brittle phases. Less brittle phases, in turn, decrease the likelihood of mechanical integrity issues.

Turbine blades or vanes 120, 130 made of a base material according to the inventive nickel-base super alloy, in particular made of the superalloy of the first or second concrete example, show a corrosion resistance which is high enough so that there is no need to provide a corrosion resistive coating on the fixing section 400.

The invention claimed is:

1. A nickel-base super alloy, comprising (in wt %):

C: ≤0.1

Si: present in an amount up to 0.2
Mn: ≤0.2
P: ≤0.005
S: ≤0.0015
Al: 4.0 to 5.5
B: ≤0.03
Co: 5.0 to 9.0
Cr: 18.2 to 19.2
Cu: ≤0.1
Fe: present in an amount up to 0.5
Hf: 0.9 to 1.3
Mg: ≤0.002
Mo: ≤0.5
N: ≤0.0015
Nb: ≤0.01
O: ≤0.0015
Ta: 4.8 to 5.2
Ti: 0.8 to 2.0
W: 1.8 to 2.5
Zr: ≤0.01
Ni: balance;
and inevitable impurities.

2. A turbine, comprising:
a turbine component made of a nickel-base super alloy as claimed in claim 1.

3. The turbine as claimed in claim 2, wherein the turbine component is a gas turbine component with a directionally solidified or single crystal structure.

4. The turbine as claimed in claim 3, wherein the component is a gas turbine blade or vane.

5. The nickel-base super alloy, which comprises (in wt %):
C: 0.03 to 0.07
Si: present in an amount up to 0.2
Mn: ≤0.2
P: ≤0.005
S: ≤0.0015
Al: 4.2 to 4.4
B: ≤0.01
Co: 7.8 to 8.5
Cr: 18.2 to 19.2
Cu: ≤0.1
Fe: present in an amount up to 0.5
Hf: 1.0 to 1.2
Mg: ≤0.002
Mo: ≤0.5
N: ≤0.0015
Nb: ≤0.01
O: ≤0.0015
Ta: 4.9 to 5.1
Ti: 1.1 to 1.3
W: 2.0 to 2.4
Zr: 0.03 to 0.07
Ni: balance
and inevitable impurities.

6. A nickel-base super alloy consisting of (in wt %):
C: 0.04
Si: 0.001
Al: 4.2
B: 0.001
Co: 8.0
Cr: 18.2
Fe: 0.07
Hf: 0.9
Nb: 0.008
Ta: 4.9
Ti: 1.1
W: 2.0
Ni: balance
and inevitable impurities.

* * * * *